US010039323B2

(12) United States Patent
Schuler et al.

(10) Patent No.: US 10,039,323 B2
(45) Date of Patent: Aug. 7, 2018

(54) VAPORIZER TANK WITH ATOMIZER

(71) Applicant: NJOY, Inc., Scottsdale, AZ (US)

(72) Inventors: David Schuler, Scottsdale, AZ (US); Ryan Miller, Scottsdale, AZ (US)

(73) Assignee: NJOY, LLC, Scottsdale, AZ (US)

( * ) Notice: Subject to any disclaimer, the term of this patent is extended or adjusted under 35 U.S.C. 154(b) by 0 days.

(21) Appl. No.: 14/801,231

(22) Filed: Jul. 16, 2015

(65) Prior Publication Data

US 2017/0013878 A1 Jan. 19, 2017

(51) Int. Cl.

| | |
|---|---|
| ***B05B 1/08*** | (2006.01) |
| ***A24F 47/00*** | (2006.01) |
| ***H05B 1/02*** | (2006.01) |

(52) U.S. Cl.

CPC ..... *A24F 47/008* (2013.01); *H05B 1/0244* (2013.01)

(58) Field of Classification Search

CPC ... A24F 47/008; A24F 47/002; H05B 1/0244; H05B 3/0014; A61M 15/06; A61M 11/042; A61M 2205/8206; A61M 11/041; A61M 15/002; A61M 15/0028

USPC ..... 239/302–350, 34–70

See application file for complete search history.

(56) References Cited

U.S. PATENT DOCUMENTS

| | | | |
|---|---|---|---|
| 374,584 | A | 12/1887 | Cook |
| 576,653 | A | 2/1897 | Bowlby |
| 595,070 | A | 12/1897 | Oldenbusch |
| 799,844 | A | 9/1905 | Fuller |
| 969,076 | A | 8/1910 | Pender |
| 1,067,531 | A | 7/1913 | MacGregor |
| 1,163,183 | A | 12/1915 | Stoll |
| 1,299,162 | A | 4/1919 | Fisher |
| 1,505,748 | A | 3/1924 | Tamis |
| 1,552,877 | A | 9/1925 | Phillipps et al. |
| 1,632,335 | A | 6/1927 | Hiering |
| 1,706,244 | A | 3/1929 | Meyerson |
| 1,845,340 | A | 2/1932 | Ritz |
| 1,972,118 | A | 9/1934 | McDill |
| 1,998,683 | A | 4/1935 | Montgomery |
| 2,031,363 | A | 2/1936 | Erikson |
| 2,039,559 | A | 5/1936 | Segal |
| D107,794 | S | 1/1938 | Rathbun |
| 2,327,120 | A | 11/1940 | McCoon |
| 2,231,909 | A | 2/1941 | Hempel |

(Continued)

FOREIGN PATENT DOCUMENTS

| | | | |
|---|---|---|---|
| CN | 201290340 | Y | 8/2009 |
| CN | 101869356 | A | 10/2010 |

(Continued)

*Primary Examiner* — Arthur O Hall
*Assistant Examiner* — Adam J Rogers
(74) *Attorney, Agent, or Firm* — Bookoff McAndrews, PLLC

(57) ABSTRACT

A tank of a vaporizing device is described, wherein the tank may comprise an atomizer and a reservoir for containing a liquid adjacent to the atomizer. The atomizer may include a wick and a heating element, wherein the tank includes a barrier that separates the wick from liquid in the reservoir. The barrier may be at least partially permeable to allow for transfer of liquid from the reservoir to the wick for vaporization. The tank may include a connector coupled to the atomizer and configured to electrically connect the atomizer to a power supply.

20 Claims, 7 Drawing Sheets
(5 of 7 Drawing Sheet(s) Filed in Color)

100

(56) References Cited

U.S. PATENT DOCUMENTS 2,460,427 A 2/1949 Musselman et al.
2,483,304 A 9/1949 Vogel
2,502,561 A 4/1950 Ebert
2,765,949 A 10/1956 Hillman
2,897,958 A 8/1959 Tarleton
3,146,937 A 9/1964 Vesak
D207,179 S 3/1967 Kanamaru
3,420,360 A 1/1969 Young
3,567,014 A 3/1971 Feigelman
3,743,136 A 7/1973 Chambers
3,861,523 A 1/1975 Fountain et al.
3,941,300 A 3/1976 Troth
D244,355 S 5/1977 Mazie et al.
D244,784 S 6/1977 O'Brien
D251,360 S 3/1979 Collin
4,207,976 A 6/1980 Herman
D269,068 S 5/1983 Mann et al.
4,460,105 A 7/1984 Cox
4,519,319 A 5/1985 Howlett
4,771,796 A 9/1988 Myer
4,798,310 A 1/1989 Kasai et al.
4,813,536 A 3/1989 Willis
4,848,375 A 7/1989 Patron et al.
4,848,563 A 7/1989 Robbins
5,005,759 A 4/1991 Bouche
5,123,530 A 6/1992 Lee
5,269,327 A 12/1993 Counts et al.
5,465,738 A 11/1995 Rowland
5,566,855 A 10/1996 Bradach
5,605,226 A 2/1997 Hernlein
D379,248 S 5/1997 Khemarangsan
5,641,064 A 6/1997 Goserud
5,746,587 A 5/1998 Racine et al.
5,810,164 A 9/1998 Rennecamp
5,881,884 A 3/1999 Podosek
5,938,018 A 8/1999 Keaveney et al.
5,967,310 A 10/1999 Hill
5,975,415 A 11/1999 Zehnal
5,979,460 A 11/1999 Matsumura
6,050,420 A 4/2000 Green
6,125,082 A 9/2000 Reid
D441,494 S 5/2001 Chen
6,269,966 B1 8/2001 Pallo et al.
6,386,371 B1 5/2002 Parsons
6,431,363 B1 8/2002 Hacker
6,446,793 B1 9/2002 Layshock
6,474,342 B1 11/2002 Rennecamp
6,510,982 B2 1/2003 White et al.
D472,463 S 4/2003 Kinigakis
6,557,708 B2 5/2003 Polacco
6,622,867 B2 9/2003 Menceles
6,672,762 B1 1/2004 Faircloth
6,726,006 B1 4/2004 Funderburk et al.
D498,877 S 11/2004 Sher
7,000,775 B2 2/2006 Gelardi
D528,411 S 9/2006 Nehus et al.
D548,592 S 8/2007 Kudo et al.
7,374,048 B2 5/2008 Mazurek
D575,149 S 8/2008 Baranowski
7,546,703 B2 6/2009 Johnske et al.
7,621,403 B2 11/2009 Althoff et al.
7,644,823 B2 1/2010 Gelardi et al.
D613,171 S 4/2010 Sempe
D625,466 S 10/2010 Martin
7,815,332 B1 10/2010 Smith
7,886,507 B2 2/2011 McGuinness, Jr.
7,988,034 B2 8/2011 Pezzoli
8,141,701 B2 3/2012 Hodges
8,314,591 B2 * 11/2012 Terry ..... A24F 47/008 320/114
8,443,534 B2 5/2013 Goodfellow et al.
D683,898 S 6/2013 Liu
8,464,867 B2 6/2013 Holloway et al.
D690,461 S 9/2013 Chen
8,539,959 B1 9/2013 Scatterday
8,596,460 B2 12/2013 Scatterday
D700,070 S 2/2014 Markovic
8,689,805 B2 4/2014 Hon
8,794,434 B2 8/2014 Scatterday et al.
8,833,364 B2 * 9/2014 Buchberger ..... A61M 11/041 128/200.14
D721,577 S 1/2015 Scatterday
D725,823 S 3/2015 Scatterday et al.
9,010,335 B1 4/2015 Scatterday
9,089,166 B1 7/2015 Scatterday
2001/0032795 A1 10/2001 Weinstein et al.
2001/0052480 A1 12/2001 Kawaguchi et al.
2002/0043554 A1 4/2002 White et al.
2002/0175164 A1 11/2002 Dees et al.
2003/0063523 A1 4/2003 Mulaw
2003/0089377 A1 5/2003 Hajaligol et al.
2004/0149624 A1 8/2004 Wischusen, II et al.
2004/0216753 A1 11/2004 Fox
2005/0016550 A1 * 1/2005 Katase ..... A24F 47/002 131/194
2005/0061759 A1 3/2005 Doucette
2005/0118545 A1 6/2005 Wong
2005/0145533 A1 7/2005 Seligson
2005/0172976 A1 8/2005 Newman et al.
2005/0236282 A1 10/2005 Huska
2006/0054676 A1 3/2006 Wischusen, III
2006/0150991 A1 7/2006 Lee
2006/0254948 A1 11/2006 Herbert et al.
2006/0255105 A1 11/2006 Sweet
2007/0062548 A1 3/2007 Horstmann et al.
2007/0098148 A1 5/2007 Sherman
2007/0235046 A1 10/2007 Gedevanishvili
2007/0267033 A1 11/2007 Mishra et al.
2008/0092912 A1 4/2008 Robinson et al.
2008/0241255 A1 10/2008 Rose et al.
2008/0276947 A1 11/2008 Martzel
2009/0095311 A1 4/2009 Han
2009/0267252 A1 10/2009 Ikeyama
2009/0288669 A1 11/2009 Hutchens
2010/0000672 A1 1/2010 Fogle
2010/0031968 A1 2/2010 Sheikh et al.
2010/0186757 A1 7/2010 Crooks et al.
2010/0200006 A1 8/2010 Robinson et al.
2010/0242974 A1 9/2010 Pan
2010/0275938 A1 11/2010 Roth et al.
2010/0276333 A1 11/2010 Couture
2010/0307116 A1 12/2010 Fisher
2011/0036346 A1 * 2/2011 Cohen ..... A61M 15/0065 128/200.14
2011/0049226 A1 3/2011 Moreau et al.
2011/0155153 A1 6/2011 Thorens et al.
2011/0180433 A1 6/2011 Rennecamp
2011/0162667 A1 7/2011 Burke et al.
2011/0168194 A1 7/2011 Hon
2011/0232654 A1 9/2011 Mass
2011/0240494 A1 10/2011 Vecchi
2011/0265806 A1 11/2011 Alarcon et al.
2011/0277780 A1 11/2011 Terry et al.
2011/0278189 A1 11/2011 Terry et al.
2011/0315701 A1 12/2011 Everson
2012/0060853 A1 3/2012 Robinson et al.
2012/0111347 A1 5/2012 Hon
2012/0204889 A1 8/2012 Xiu
2012/0227753 A1 9/2012 Newton
2012/0230659 A1 * 9/2012 Goodman ..... F22B 1/282 392/395
2012/0261286 A1 10/2012 Holloway et al.
2012/0267383 A1 10/2012 Van Rooyen
2013/0081642 A1 * 4/2013 Safari ..... A24F 47/008 131/329
2013/0087160 A1 * 4/2013 Gherghe ..... A24F 1/00 131/329
2013/0140200 A1 6/2013 Scatterday
2013/0228191 A1 * 9/2013 Newton ..... A24F 47/008 131/329
2013/0247924 A1 9/2013 Scatterday et al.
2013/0248385 A1 9/2013 Scatterday et al.
2013/0276802 A1 10/2013 Scatterday
2013/0284190 A1 10/2013 Scatterday et al.

(56) References Cited

U.S. PATENT DOCUMENTS

| | | | | |
|---|---|---|---|---|
| 2013/0284191 | A1 | 10/2013 | Scatterday et al. | |
| 2013/0298905 | A1* | 11/2013 | Levin | A24F 47/008 128/202.21 |
| 2013/0306065 | A1* | 11/2013 | Thorens | A24F 47/008 128/202.21 |
| 2013/0313139 | A1 | 11/2013 | Scatterday et al. | |
| 2013/0341218 | A1 | 12/2013 | Liu | |
| 2014/0014124 | A1 | 1/2014 | Glasberg et al. | |
| 2014/0053858 | A1 | 2/2014 | Liu | |
| 2014/0123989 | A1* | 5/2014 | LaMothe | A24F 47/008 131/328 |
| 2014/0182610 | A1 | 7/2014 | Liu | |
| 2014/0190496 | A1* | 7/2014 | Wensley | A24F 47/008 131/273 |
| 2014/0196716 | A1 | 7/2014 | Liu | |
| 2014/0196731 | A1 | 7/2014 | Scatterday | |
| 2014/0261495 | A1* | 9/2014 | Novak, III | A24F 47/008 131/329 |
| 2014/0345635 | A1 | 11/2014 | Rabinowitz et al. | |
| 2014/0353856 | A1 | 12/2014 | Dubief | |
| 2014/0374289 | A1 | 12/2014 | Liu | |
| 2015/0059784 | A1 | 3/2015 | Liu | |
| 2015/0101945 | A1 | 4/2015 | Scatterday | |

FOREIGN PATENT DOCUMENTS

| | | | |
|---|---|---|---|
| CN | 202122096 | U | 1/2012 |
| CN | 203318894 | U | 12/2013 |
| CN | 203435686 | U | 2/2014 |
| CN | 203492785 | U | 3/2014 |
| EP | 2186537 | A1 | 5/2010 |
| EP | 2253233 | A1 | 11/2010 |
| EP | 2325093 | A1 | 5/2011 |
| JP | 2001-165437 | A | 6/2001 |
| WO | WO-2011/033396 | A1 | 3/2011 |
| WO | WO-2011/117580 | A2 | 9/2011 |
| WO | WO-2012/021972 | A1 | 2/2012 |
| WO | WO 2012/109371 | A1 | 8/2012 |
| WO | WO 2013/141906 | | 9/2013 |
| WO | WO 2013/141907 | | 9/2013 |
| WO | WO 2013/141994 | | 9/2013 |
| WO | WO 2013/141998 | | 9/2013 |
| WO | WO 2013/142671 | | 9/2013 |
| WO | WO 2013/142678 | | 9/2013 |
| WO | WO 2014/113592 | | 7/2014 |

* cited by examiner

VAPORIZER TANK WITH ATOMIZER

TECHNICAL FIELD

The present disclosure generally relates to electronic vaporization devices, components thereof, and related methods of use.

BACKGROUND

Electronic Nicotine Delivery Systems (ENDS) are currently available as alternatives to combustion cigarettes. Examples of ENDS devices include electronic vaporizers, such as, e.g., disposable and rechargeable electronic cigarettes, electronic vaporizers/vape pens, and advanced personal vaporizers (APVs). Some ENDS devices include an atomizer with a reservoir that contains a liquid, and a wick in contact with the liquid in the reservoir. Typically, the atomizer has a heating element and a power source for providing heat to vaporize the liquid. The atomizer is usually enclosed in a metal housing with holes that expose the wick to the liquid in the reservoir. The atomizer assembly is located at the end of the reservoir and is submerged in liquid in order for the wick to replenish vaporized liquid.

Vapor output is a characteristic important to many users, wherein higher vapor output is often correlated with greater user satisfaction. The amount of vapor produced by a device can depend on many different parameters. In some cases, for example, vapor output can be increased by delivery of more electrical power to the atomizer. But higher power also may lead to undesirable effects. For example, driving the battery to deliver more power can shorten the life of the battery. While larger batteries may be capable of increasing power, the increased power may come at the expense of portability of the device since the overall size and weight of the device is increased. Larger devices also may be more conspicuous, whereas some users may prefer devices that are more discreet. Delivering more power to the atomizer also can lead to intermittent drying of the wick and/or overheating, which in turn can cause degradation of the liquid. Degradation products of the liquid can result in poor taste and/or may be harmful to health. The risks of wick drying and overheating are expected to increase as users apply more power.

SUMMARY OF THE DISCLOSURE

Embodiments of the present disclosure may provide a relatively more efficient atomizer, e.g., for delivering an equivalent or comparable amount of vapor at a lower power level, which may extend the life of the battery and/or allow use of a smaller battery. Embodiments of the present disclosure include vaporizing devices that may deliver a greater amount and/or higher quality vapor using a smaller or otherwise more efficient battery. Devices according to the present disclosure may be relatively more compact and portable.

The present disclosure includes a tank for a vaporizing device, the tank comprising an atomizer including a wick and a heating element; a reservoir adjacent to the atomizer, the reservoir being configured to contain a liquid; and a barrier that separates the wick from the reservoir, the barrier being at least partially permeable to allow for transfer of liquid from the reservoir to the wick. The heating element may be at least partially surrounded by the wick and/or the heating element may comprise a coil extending along a longitudinal axis of the tank. The barrier may comprise an absorbent material and/or may include a central opening for receiving vaporized liquid from the atomizer. The reservoir may define a container coupled to the barrier, such that the liquid exits the reservoir only through the barrier. The tank may comprise a mouthpiece integral with the reservoir, and/or the reservoir may be transparent.

According to some aspect of the disclosure, the atomizer may include a housing and an air gap between at least a portion of the wick and the housing. The atomizer may include an outer housing and an insulation element coupled to an inner surface of the outer housing to at least partially insulate the outer housing from heat generated by the heating element. The reservoir may be detachable from the atomizer, e.g., for filling the reservoir with liquid. Further, for example, the tank may comprise a connector coupled to the atomizer, wherein the connector is configured to electrically connect the atomizer to a power supply. The connector may include a skirt portion that extends from an end of the atomizer and/or the connector may comprise a housing that includes at least one notch to provide an air inlet in communication with an airway of the tank. The skirt portion may be integral with the housing of the connector, for example. According to some aspects, the tank may further comprise a sleeve coupled to an outer surface of the connector housing, the sleeve including at least one aperture that corresponds to the at least one notch of the connector, wherein the sleeve is moveable with respect to the connector for adjusting a size of the air inlet.

The present disclosure further includes a tank for a vaporizing device, the tank comprising a housing that contains a wick and a heating element; a reservoir adjacent to the housing, the reservoir being configured to contain a liquid; and a barrier that separates the wick from the reservoir, the barrier being at least partially permeable to allow for transfer of liquid from the reservoir to the wick; wherein the heating element is separated from the housing by an air gap. The housing may contain an insulation element coupled to an inner surface of the housing to at least partially insulate the housing from heat generated by the heating element. The reservoir may defines a container coupled to the barrier, such that the liquid exits the reservoir only through the barrier.

The present disclosure further includes a tank for a vaporizing device, the tank comprising an atomizer including a housing that contains a wick, a heating element at least partially surrounded by the wick, a barrier, and an insulation element; and a reservoir adjacent to the atomizer, the reservoir being configured to contain a liquid; wherein the barrier of the atomizer separates the wick from the reservoir, the barrier being at least partially permeable to allow for transfer of liquid from the reservoir to the wick; and wherein the insulation element is coupled to the housing to at least partially insulate the housing from heat generated by the heating element. The tank may further comprise a connector coupled to the atomizer, wherein the connector is configured to electrically connect the atomizer to a power supply.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 6A shows an exploded view of FIG. 6B.

DETAILED DESCRIPTION

Embodiments of the present disclosure may overcome one or more shortcomings of current devices discussed above. For example, the devices disclosed herein may increase the efficiency of the atomizer (e.g., higher vapor output per amount of power input), which may provide for longer battery lifetimes and/or a higher number of puffs over the lifetime of the device. In some embodiments, the device may include an atomizer adjacent to a liquid reservoir and farther from the mouthpiece and the user's mouth when in use. The atomizer may include an insulated chamber, as discussed further below.

The term "about" refers to being nearly the same as a referenced number, or value. As used herein, the term "about" generally should be understood to encompass ±5% of a specified amount or value.

Figure 1:
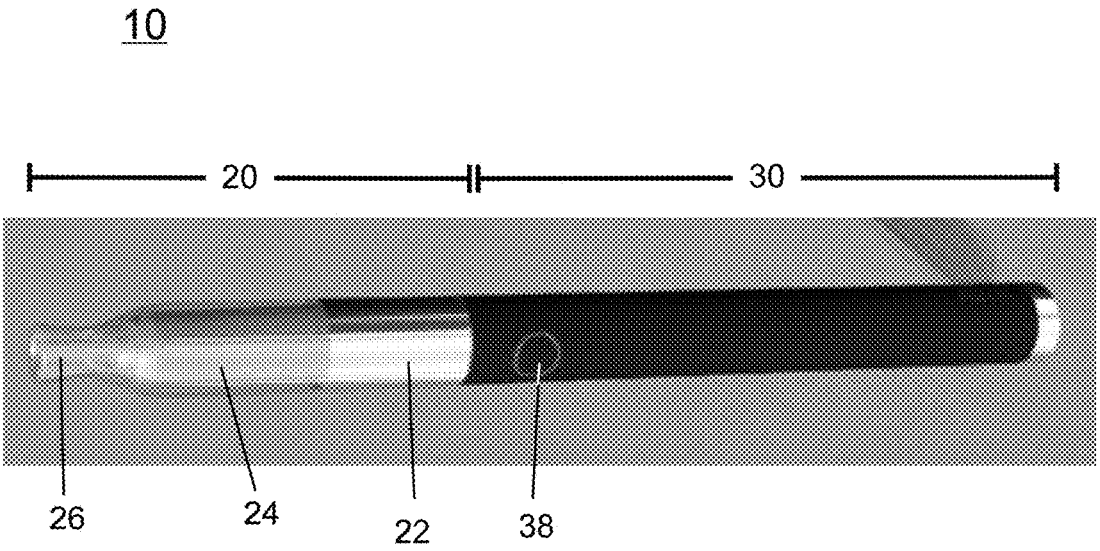
FIG. 1 shows an exemplary vaporizing device including a tank and power source, in accordance with one or more embodiments of the present disclosure.

FIG. 1 shows an exemplary device 10 comprising a vaporization component or tank 20 and a power component 30. The tank 20 may include an atomizer 22 and a reservoir 24 for holding liquid for vaporization. The tank 20 also may include a mouthpiece 26 configured for placement in a user's mouth during use. The mouthpiece 26 may be integral with the tank 20 or may be detachable, e.g., to allow a user to remove and exchange different mouthpieces. For example, the tank 20 may include mating elements (e.g., threads, clips, locking tabs, friction fit, etc.) complementary to mating elements of the mouthpiece 26 for securing the mouthpiece 26 to the tank 20. The power component 30 may comprise a rechargeable or non-rechargeable battery, or other suitable power source for supplying power to the atomizer 22. For example, the power component 30 may comprise a vape pen power supply. In some embodiments, the power component 30 may include an element for receiving user input to activate the device, e.g., a power switch or power button 38. Additionally or alternatively, the device 10 may include sensors and/or processors to activate and/or control the device 10 based on sensory input, such as pressure change due to inhaling.

The tank 20 may be at least partially transparent or translucent to allow for monitoring the liquid level with use and over time. The device 10 may be configured for re-use by replenishing a supply of liquid in the reservoir 24 of the tank 20 and/or recharging a battery of the power component 30. For example, the tank 20 may be liquid-tight. In some embodiments, the tank 20 may be fixedly or removably attached to the power component 30. For example, the tank 20 may be detachably coupled to the power component 30 via mating elements (e.g., threads, clips, locking tabs, friction fit, etc.) complementary to mating elements of the power component 30, such that each of the tank 20 and the power component 30 has a separate housing. A user therefore may detach the tank 20 from the power component 30 in order to repair, recharge, or replace the tank 20 or the power component 30 as needed or desired. In some embodiments, the tank 20 may be prefilled with liquid and intended to be discarded (e.g., replaced with a new prefilled tank 20) when the liquid is depleted or falls below a threshold level. In some embodiments, the tank 20 may be integral with the power component 30, such that the device 10 comprises a single housing. For example, the device 10 may be intended to be discarded when depleted of liquid for vaporization and/or upon reaching the end of battery life.

Each of the tank 20 and the power component 30 may have any suitable shape and dimensions. In some embodiments, the device 10 may have a generally cylindrical shape, as shown in FIG. 1. The total length of the device 10 may range from about 10 cm to about 15 cm, such as from about 11 cm to about 14 cm, e.g., a length of about 12 cm, about 12.5 cm, about 13 cm, or about 13.5 cm. The tank 20 and the power component 30 may have the same outermost diameter, such that the surface of the device 10 is flush when the tank and the power component 30 are coupled together. The outermost diameter of the device 10 may range from about 11 mm to about 16 mm, e.g., an outermost diameter of about 11 mm, about 11.5 mm, about 12 mm, about 12.5 mm, about 13 mm, about 13.5 mm, about 14 mm, about 14.5 mm, about 15 mm, about 15.5 mm, or about 16 mm.

The tank 20 may taper proximate the mouthpiece 26, such that the mouthpiece 26 has a smaller diameter than the outermost diameter of the tank 20. In some embodiments, the mouthpiece 26 may have a generally hourglass shape as shown in FIG. 1, wherein the tank tapers to a smaller outer diameter, e.g., ranging from about 3 mm to about 7 mm, proximate the end of the mouthpiece 26, and then tapers so a larger outer diameter at the end of the mouthpiece 26. The length of the tank 20 may range from about 5 cm to about 8 cm, such as from about 6 cm to about 7 cm, e.g., a length of about 6.5 cm. The length of the power component 30 may range from about 6 cm to about 10 cm, such as from about 7 cm to about 9 cm, e.g., a length of about 7 cm, about 7.5 cm, or about 8 cm.

Figure 2:
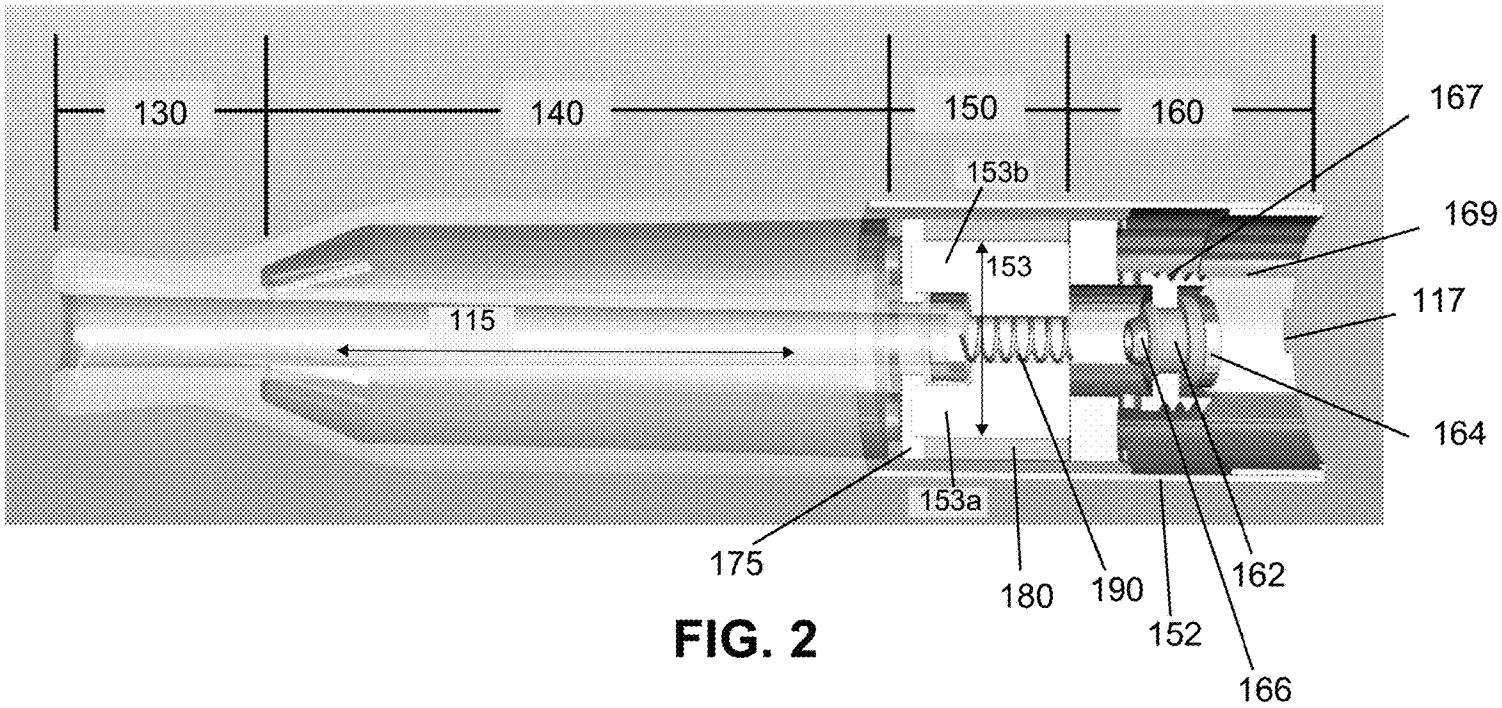
FIG. 2 is a section view of an exemplary tank, in accordance with one or more embodiments of the present disclosure.
Figure 3:
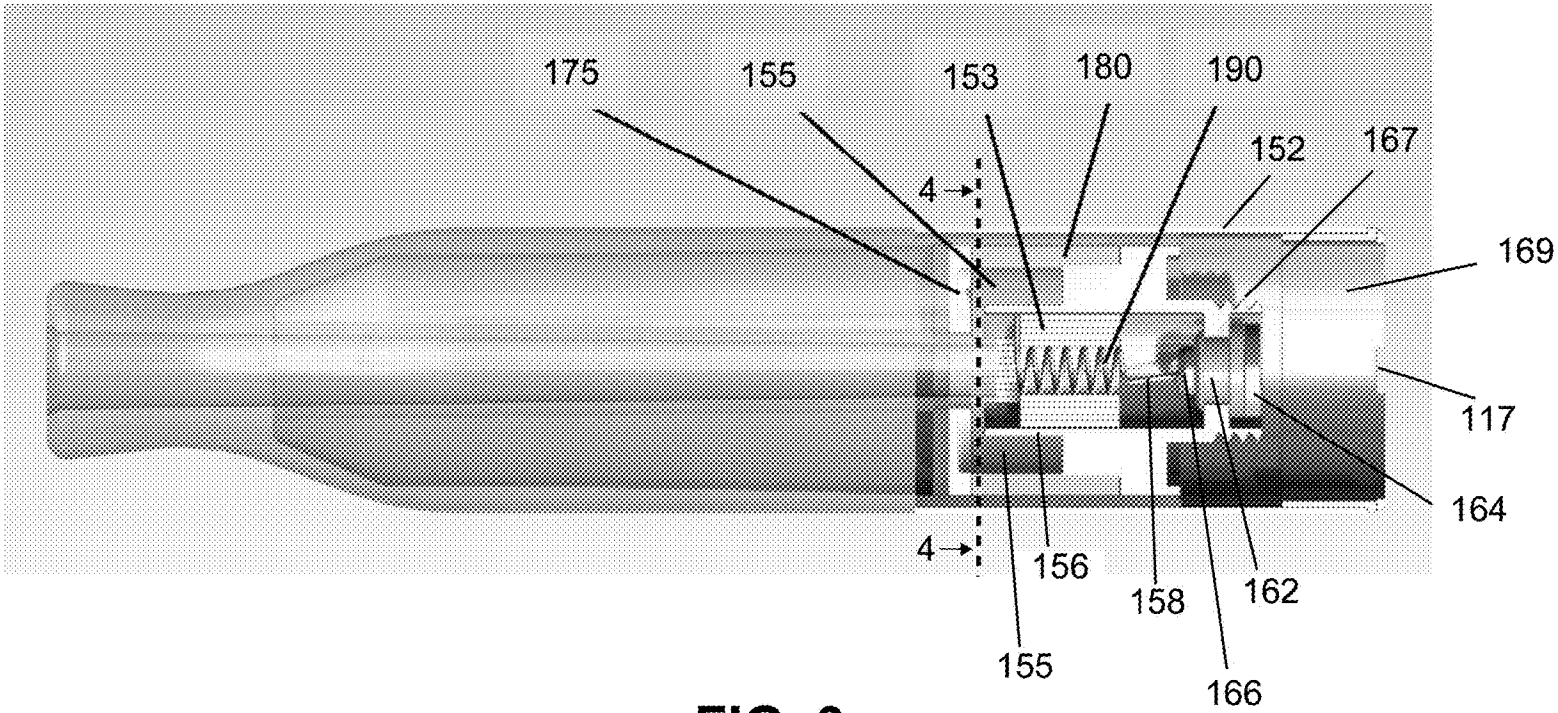
FIG. 3 is a section view of the tank shown in FIG. 2, rotated 90°.

FIGS. 2 and 3 shows an exemplary tank 100, which may be substantially similar to, and include any of the feature of, the tank 20 of FIG. 1. The tank 100 may be configured for use in combination with a power source, such as power component 30 as described above. As shown, the tank 100 includes a mouthpiece 130, a reservoir 140, an atomizer 150, and a connector 160, e.g., for connecting to a power component. In some embodiments, the mouthpiece 130 may be located at the proximal-most end of the tank 100 nearest the mouthpiece 130 and a user's mouth during use, and the connector 160 may be located at the distal-most end of the tank 100, farthest from the mouthpiece 130 and the user's mouth during use. In an exemplary embodiment, the atomizer 150 may be between the distal end of the reservoir 140 and the proximal end of the connector 160, e.g., as shown in FIGS. 2 and 3.

Figure 4:
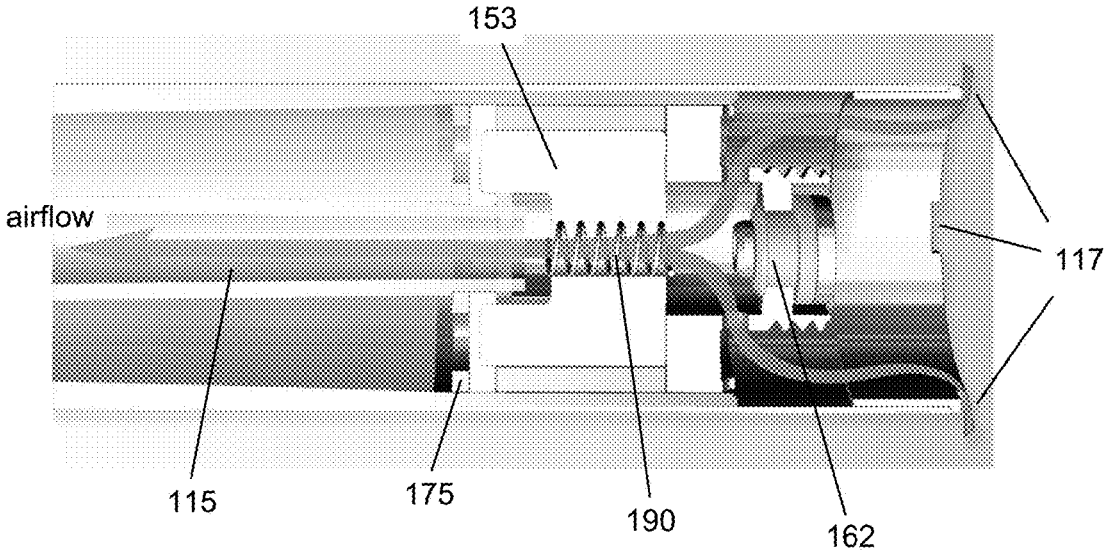
FIG. 4 illustrates airflow through the tank of FIG. 2.

The tank 100 may include an airway 115 extending through each of the mouthpiece 130, the reservoir 140, the atomizer 150, and the connector 160. For example, the connector 160 may define one or more inlets in communication with the external environment, e.g., via one or more notches 117 at or proximate the distal end of the connector 160, when connected to a power component, such as power component 30 discussed above. The connector 160 may include, for example, 1, 2, 3, 4, or more notches, which may be equally spaced from one another. For example, the connector 160 may include 2 notches spaced 180 degrees apart from each other, 3 notches spaced 120 degrees from one other, or 4 notches spaced 90 degrees from one other. Air may enter the device through the inlet(s) defined by the notches 117 and be drawn through the airway 115 towards the outlet of the airway 115 at the mouthpiece 130 when a user inhales. FIG. 4 shows an exemplary pathway for air entering via three notches 117 and flowing through the airway from the atomizer 150 through the reservoir 140.

The reservoir 140 may be configured to contain a liquid for vaporization via the atomizer 150. The tank 100 may allow a user to view the contents of the reservoir 140 (the tank 100 comprising clear glass or plastic, for example) to determine the amount of liquid remaining for vaporization. In some embodiments, the reservoir 140 may be at least partially or fully separated from the atomizer 150, such that liquid in the reservoir 140 is not in direct contact with one or more components of the atomizer 150. For example, the atomizer 150 may comprise a wick 153 and a heating element 190 each separated from liquid in the reservoir 140 by a barrier 175 between the reservoir 140 and the atomizer 150. The barrier 175 may define a proximal end of the atomizer 150 or may be disposed proximate the proximal end of the atomizer 150. The reservoir 140 may have a continuous housing without any openings that would allow a user to refill the reservoir 140 with liquid. For example, the reservoir 140 may define a container coupled to, and in communication with the barrier 175, such that the liquid may only exit the reservoir 140 through the barrier 175. Thus, the tank 100 may be provided to a user prefilled with liquid, to be discarded once the liquid is consumed. In other embodiments, the tank 100 may be configured to allow a user to refill the reservoir 140, e.g., via an opening or inlet in the wall of the reservoir that is closed to the external environment during use. In some embodiments, the reservoir 140 may be detachable from the atomizer 150, such that a user may detach a used reservoir 140 (e.g., a reservoir empty or nearly empty of liquid) from the atomizer 150, and reattach a replacement or refilled reservoir 140 to the atomizer 150 for subsequent use. For example, the contents of the reservoir 140 may only be accessible to the user upon detaching the reservoir 140 from the atomizer 150.

The barrier 175 may be absorbent, permeable, or semi-permeable to allow liquid to travel from the reservoir 140 to the atomizer 150. The barrier 175 may be generally disk-shaped with an opening in the center for the airway 115, such that vaporized liquid may pass from the atomizer 150 through the reservoir 140 to exit the tank 100 through the mouthpiece 130. Exemplary materials suitable for the barrier 175 include, but are not limited to, fibrous materials such as cotton or fiberglass, and materials such as ceramics or silica configured into a permeable or semi-permeable matrix (e.g., glass frit). The barrier 175 may extend along the majority of the width of the tank 100 or any other portion of the width. In cases where the tank 100 is generally cylindrical in shape, the barrier 175 may generally correspond to the internal cross-sectional diameter of the tank 100 (i.e., the diameter between inside surfaces of the housing of the tank 100).

This configuration may prevent or minimize heat loss from the heating element 190. Without being bound by theory, it is believed that inefficiencies may arise due to the conduction of heat generated by the heating element 190 through the wick 153 to the housing and/or other portions of the tank 100 or device. For example, at least a portion of the tank 100 may comprise a metal or metal alloy that, without insulation, may conduct heat from the heating element 190. For example, the atomizer 150 may include a sleeve or outer housing 152, which may comprise metal to absorb and conduct heat. The outer housing 152 may in turn transfer heat to other portions of the tank 100 such as, e.g., into the liquid in the reservoir 140, where the heat may be readily dissipated and unavailable for vaporization.

One side of the barrier 175 (e.g., a proximal side of the barrier 175) may be in contact with liquid of the reservoir 140, while the opposite side of the barrier 175 (e.g., a distal side of the barrier 175) may be in contact with the wick 153. The liquid may be retained in the tank 100 through interaction of the liquid's surface tension over the surface area of the barrier 175, balanced with the reduced pressure at the top (i.e., the mouthpiece end) of the reservoir 140 due to the weight of the liquid contained therein. The barrier 175 may serve one or more functions. For example, the barrier 175 may serve to contain the liquid by acting as the distal end wall of the reservoir 140. Further, for example, the permeability of the barrier 175 may allow the barrier 175 to act as a conduit enabling liquid to be transferred from the reservoir 140 to the wick 153 in the atomizer 150, the wick 153 being in contact with the opposite (distal) side of the barrier 175. Still further, for example, the barrier 175 may allow air to freely pass into the reservoir 140, e.g., to maintain pressure equilibrium. For example, during use, the wick 153 may draw liquid from or through the barrier 175 to replenish the vaporized liquid. The barrier 175, in turn, may draw liquid from the reservoir 140 to replenish the liquid drawn into the wick 153. As liquid is withdrawn from the reservoir 140, the internal pressure of the reservoir 140 may be reduced. The porosity of the barrier 175 may allow air to enter the tank 100 until the pressure is at equilibrium across the barrier 175.

The wick 153 may comprise an absorbent material and/or be adsorbent to allow liquid to saturate the wick 153. Exemplary materials suitable for the wick 153 include, but are not limited to, fibrous absorbent materials such as cotton (including, e.g., organic cotton), fiberglass, and materials such as ceramics or silica with permeable, semi-permeable, or adsorbent properties. In at least one embodiment, the wick is constructed from organic cotton. In some embodiments, the total length of the wick may range from about 20 mm to about 40 mm, such as from about 25 mm to about 35 mm.

In some embodiments, the wick 153 may have a generally rectangular configuration, as illustrated in FIGS. 2-4. FIG. 2 shows the tank 100 oriented such that the entire width of the wick 153 (as measured along the diameter of the atomizer) is in view. FIG. 3 shows the tank 100 rotated 90 degrees, rotating the plane of the wick 153 such that the side edge of the wick 153 is visible. The wick 153 may comprise a single layer of material or may have a multilayered structure (e.g., comprising multiple layers of cotton or other fibrous material). An exemplary multilayered structure, each layer having a generally rectangular shape, is illustrated with individual layers visible in FIGS. 3 and 5.

Figure 5:
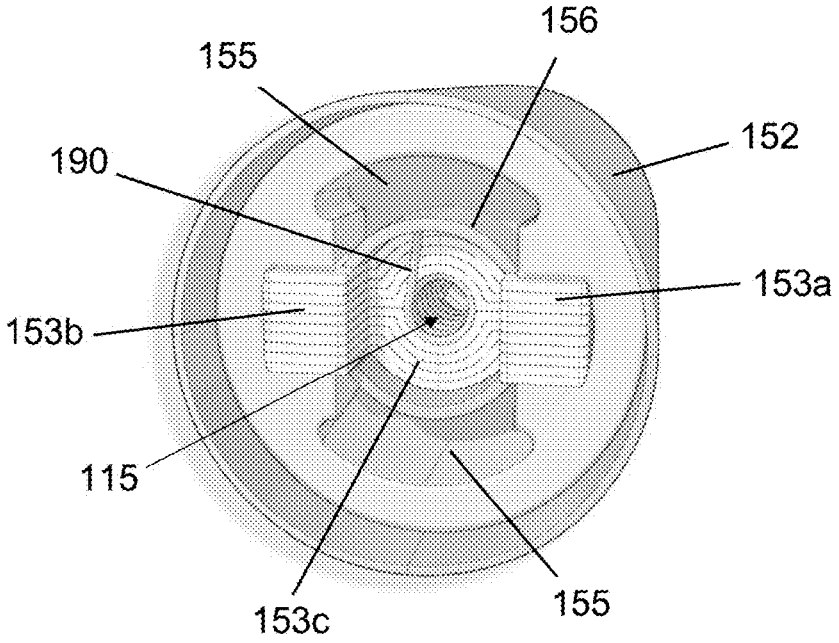
FIG. 5 shows a top cross-sectional view of the tank of FIG. 2.

FIG. 5 shows a top view (proximal end view) of the atomizer 150 (without the barrier 175 for clarity), showing the proximal end of each of the wick 153 and the heating element 190. As mentioned above, the wick 153 may at least partially or completely surround the heating element 190. The wick 153 may include two flat sides 153*a*, 153*b*, and a middle bulging portion 153*c* where the wick 153 surrounds the cylindrical heating coil 190. In some embodiments, the wick 153 may be formed of two or more pieces of sheets of material pressed together around the heating element 190. For example, the wick 153 may comprise two pieces of material that sandwich the heating element 190.

In at least one embodiment, the wick 153 may be made of absorbent material and the heating element 190 may comprise a resistive heating wire, each of the wick 153 and the heating element 190 being located outside the reservoir 140. The wick 153 may at least partially or completely surround the heating element 190, such that liquid absorbed by the wick 153 may be heated and subsequently vaporize. In some embodiments, the heating element 190 may comprise a wire coil arranged in a vertical or horizontal orientation and open in the center to define a portion of the airway 115. For example, FIGS. 2 and 3 illustrate an example wherein the heating element 190 comprises a vertical coil (the coil extending along a longitudinal axis of the tank 100) that creates a coaxial void to define a portion of the airway 115 for receiving and transferring airflow. In some embodiments, the heating element 190 may comprise a coil that extends diametrically across the airway 115, e.g., in a space between the reservoir 140 and the connector 160. Exemplary materials suitable for the heating element 190 include metals and metal alloys such as, e.g., nichrome (nickel-chromium alloy), iron-chromium-aluminum alloy (e.g., Kanthal™ alloys), and any other metals and alloys providing for a high resistance wire. In at least one embodiment, the heating element 190 is formed from Kanthal™ wire.

The heating element 190 may be operably coupled to the connector 160, e.g., for providing power to the heating element 190 from a power source (such as, e.g., power component 30 of FIG. 1) coupled to the connector 160. For example, wire ends of the heating element 190 may be attached to larger diameter wires that enable current to flow from the power source to the heating element 190. In some embodiments, the wick 153 may be retained by a wall inside the atomizer 150, which may be spaced from the atomizer housing. FIG. 5 shows the wick 153 retained within a relatively thin, walled structure 156, shown as having a cylindrical shape, coaxial to the heating coil 190. The walled structure 156 may define one or more slots therethrough that permit the wick 153 to extend outward proximally (in a direction towards the reservoir 140) from the atomizer 150 and receive the liquid in the reservoir 140 via the barrier 175 as discussed above. The walled structure 156 may extend proximally from the connector 160. In some embodiments, for example, the atomizer 150 may be integral with the connector 160.

The entire assembly of the wick 153, heating element 190, and walled structure 156 may be surrounded by an insulating element 180, e.g., an annular ring, providing insulation between the assembly and the outer housing of the atomizer 150. The insulating element 180 may comprise any suitable material, e.g., to isolate and/or insulate the atomizer assembly from the atomizer sleeve housing 152. In some embodiments, the insulating element 180 may have a thickness ranging from about 0.5 mm to about 1.5 mm, e.g., a thickness of about 1 mm. In some embodiments, the insulating element 180 may comprise a silicone ring. Spaces above and below the plane of the wick 153 (radially outward of the wick 153) may establish an insulated chamber or air gap 155, which may further reduce heat loss to the housing of the tank 100. The insulating air gap 155 may be located between the walled structure 156 and the insulating element 180 on one or both sides of the wick 153. The air gap(s) 155 may extend substantially the entire length of the wick 153 (measured along the longitudinal axis of the tank 100) or only a portion thereof. The distal end of the wick 153 may be adjacent to the proximal end of the connector 160.

In some embodiments, the atomizer may comprise a wick formed of twisted fibers with a heating wire serving as the heating element wrapped around the exterior of the wick. The wick and heating element may be disposed diametrically across the airway in the space between the distal end of the reservoir and the proximal end of the connector. The ends of the wick may extend to contact the barrier on the distal end of the reservoir. The atomizer may be surrounded by air in an insulated chamber. The entire assembly of the wick and the heating element may be surrounded by an insulating element providing insulation between the assembly and the outer housing of the atomizer. An insulating air gap therefore may separate the wick and heating element from the insulating ring, except where the wick extends outward and up to the distal end of the reservoir.

The connector 160 may serve to connect the heating element 190 to a power supply in order to provide heat for vaporization. As shown in FIGS. 2 and 3, the connector 160 may include a disc 164 coupled to a tenon 162 for connection to a compatible power supply. For example, the outer surface of the tenon 162 may include threads 167 complementary to the threads of a power supply, in a standard connection generally referred to as a "510 connection" or "510 connector." Any other suitable types of connections for providing an electrical connection to the atomizer 150 may be used. Each of the disc 164 and the tenon 162 may comprise a metal or metal alloy. The tenon 162 may be hollow and define one or more radial openings, e.g., radially drilled holes, to define the airway 115, allowing air to pass from the inlets defined by the notches 117 through to the atomizer 150 as shown in FIG. 4. The proximal end of the tenon 162 may be coupled to a coaxial pin 166 separated from the tenon 162 by an electrical insulator. Thus, for example, the heating element 190 may be coupled to the connector via one or more electrical connections or wires 158, e.g., a first wire connected to the pin 166 (e.g., positive polarity) and a second wire connected to the tenon 162 (e.g., negative polarity). During use, when the power supply is connected and activated, power may be supplied to the heating element 190 through the application of voltage, e.g., DC voltage, to the pin 166 and the threads of the tenon 162. Electrical current may flow through the heating element 190, producing heat due to the electrical resistance of the heating element 190. The heat may vaporize the liquid in the wick 153 adjacent to the heating element 190. The vaporized liquid then may mix with the air being inhaled by the user through the mouthpiece of the tank 100, resulting in an aerosol that is delivered to the user.

In some embodiments, the connector 160 may include an axial extension or skirt portion 169, distal to the tenon 162 and disc 164, with the notches 117 located at a distal-most end of the skirt portion 169. Additionally or alternatively, the skirt portion 169 may include one or more notches 117 as openings proximal to the distal-most end of the skirt portion 169 (see FIGS. 6A and 6B). The skirt portion 169 may be configured as a sheath that surrounds the distal part of the tenon 162. For example, the skirt portion 169 may protect and/or hide the threads 167 of the tenon 162. In some embodiments, the skirt portion 169 may include a mating element for connecting the tank 100 to a power component. For example, an inner surface of the skirt portion 169 may include threads complementary to outer threads of a power component (e.g., power component 30 of FIG. 1).

Figure 6A:
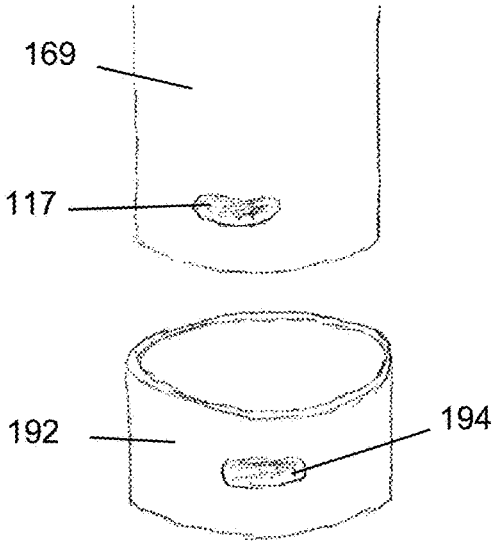
FIGS. 6A and 6B show exemplary features for adjusting airflow, in accordance with one or more embodiments of the present disclosure, where
Figure 6B:
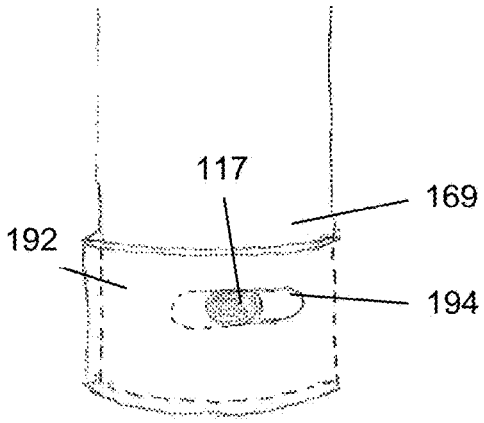

In some embodiments, the device may allow a user to increase or decrease the size of the air inlets according to preference, e.g., such that larger sized inlets may allow for greater airflow and higher vapor output, and smaller sized inlets may allow for less airflow and reduced vapor. For example, the amount or rate of airflow into the connector 160 may be controlled by a sliding element that can be adjusted by the user. FIGS. 6A and 6B illustrate an exemplary sleeve 192 coupled to the outside surface of the skirt portion 169 and having one or more apertures 194, each aperture 194 corresponding to one of the notches 117 of the skirt portion 169. The sleeve 192 may be slidably and/or rotatably coupled to the skirt portion 169, such that a user may increase or decrease the size of the air inlets by covering more or less of the notches 117 with the sleeve 192. For example, the sleeve 192 may rotate about the circumference of the skirt portion 169 and/or slide axially relative to the skirt portion 169 to adjust the position of the apertures 194 relative to the notches 117. The sleeve 192 may completely surround the skirt portion 169, e.g., as a sliding ring, or may only partially surround the skirt portion 169.

As mentioned above, in some embodiments, the tank is not fillable by the user. For example, the tank may be supplied pre-filled with liquid, and disposed of after the liquid is consumed through vaporization. In other embodiments, the tank may be configured to be filled/refilled with liquid by a user. For example, the tank reservoir may be removable from the atomizer, such that the user may remove the reservoir to fill/refill the tank with liquid, and then reassemble the reservoir to the atomizer.

Devices according to the present disclosure may increase the energy efficiency of the atomizer by reducing thermal losses to the liquid in the reservoir and the environment, which may prolong battery life. The improved efficiency may improve vapor quality, e.g., by avoiding degradation of the liquid into degradation products. The energy efficiency of tanks currently on the market generally ranges from 15-25%. Atomizers of devices according to the present disclosure may have a larger thermal efficiency, e.g., efficiency greater than about 15%, greater than about 20%, greater than about 25%, or greater than about 30%, such as an efficiency between 15% and 40%, between 20% and 35%, between 25% about 35%, or between 25% and 30%. In at least one embodiment, the thermal efficiency of the atomizer may be about 27.4%.

EXAMPLES

The following examples are intended to illustrate aspects of the present disclosure without, however, being limiting. It is understood that additional embodiments are encompassed by the disclosure herein.

The thermal efficiency of the atomizer of various vaporizing devices described in Examples 1 and 2 was measured by applying a controlled amount of power for a specified time period while measuring the mass lost to vaporization. This was accomplished by weighing the tank before power was applied to generate vapor, and then weighing it again after the power was terminated. The difference is the mass of vapor generated, referred to as Total Particulate Matter (TPM). Efficiency was calculated by dividing the theoretical energy of vaporization (the latent heat of vaporization of the mass of liquid vaporized) by the energy input.

Example 1

Figure 7:
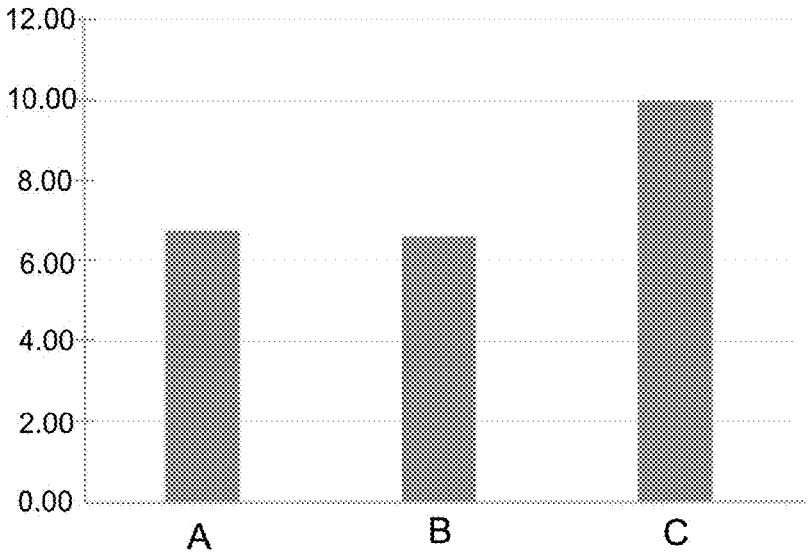
FIG. 7 shows a bar graph comparison of vapor output (mg/puff) for different devices and power levels, as discussed in Example 1.

Devices according to the present disclosure were tested at different power levels and compared to a commercially-available device of a different design. FIG. 7 shows a bar graph comparison of devices A, B, and C, wherein devices B and C included a tank 100 that separates the atomizer assembly from the liquid reservoir as described above. Device A included a different type of tank, with the atomizer assembly submerged in liquid. The same liquid was used in each device (a 50-50 mixture of propylene glycol and glycerin, with 15 mg/ml nicotine and additional flavorings). Device A was operated at 11 W, device B was operated at 9.1 W, and device C was run at 10.5 W.

The vapor output (measured as TPM, in mg/puff, on the y-axis of FIG. 7) measured shows that devices B and C generated more vapor per amount of power, relative to device A. The performance of device B was nearly equivalent to the performance of device A, with device B run at a lower power level. The performance of device C exceeded that of device A by almost 50% for comparable power levels (10.5 W for device B vs. 11 W for device A).

Example 2

Figure 8:
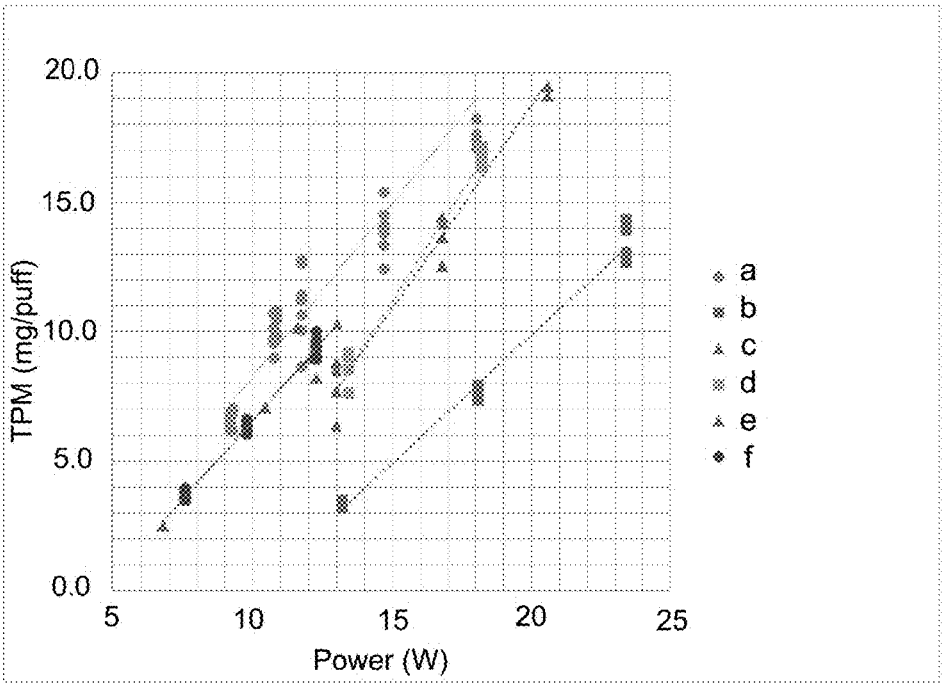
FIG. 8 shows a comparison plot of power vs. vapor output (mg/puff) for different devices, as discussed in Example 2.

The performance of a device (a) according to the present disclosure (e.g., tank 100 described above) was compared to the performance of several commercially-available devices (b)-(f), each comprising an atomizer assembly submerged in liquid. The tanks had the following resistances: device (b), 1.5Ω; device (c), 1.6Ω; device (d), 0.5Ω; device (e), 1.2Ω; device (f), 1.8Ω. The same liquid was used in each device (a 50-50 wt. mixture of propylene glycol and glycerin, with 15 mg/ml nicotine and additional flavorings). Each device was operated at a series of different power levels and the mass of vapor generated (TPM, in mg/puff) was measured. FIG. 8 shows that device (a) generated a higher amount of vapor at a given power level in comparison to devices (b)-(f).

Any features discussed on connection with a particular embodiment may be used in any other embodiment disclosed herein. Further, other embodiments of the present disclosure will be apparent to those skilled in the art from consideration of the specification and practice of the embodiments disclosed herein. It is intended that the specification and examples be considered as exemplary only, with a true scope and spirit of the present disclosure being indicated by the following claims.

We claim:

1. A tank for a vaporizing device, the tank comprising:

an atomizer having an outer housing and comprising a wick, a heating element, and an insulating element housed within the outer housing;

a reservoir adjacent to the atomizer, the reservoir being configured to contain a liquid; and a barrier that separates the wick from the reservoir, the barrier having a first side that forms an end wall of the reservoir and a second side in contact with the wick, the barrier being at least partially permeable to allow for transfer of liquid from the reservoir to the wick housed within the atomizer, wherein the wick is radially inward of a walled structure, the insulating element is radially between the walled structure and the outer housing, and an air gap is radially between the walled structure and the insulating element.

2. The tank of claim 1, wherein the wick comprises a fibrous absorbent material.

3. The tank of claim 1, wherein the heating element extends at least partially along a longitudinal axis of the tank, and wherein the wick at least partially radially surrounds the heating element.

4. The tank of claim 1, wherein the barrier comprises an absorbent material.

5. The tank of claim 1, wherein the barrier includes a central opening for receiving vaporized liquid from the atomizer.

6. The tank of claim 1, wherein the insulating element is coupled to an inner surface of the outer housing to at least partially insulate the outer housing from heat generated by the heating element.

7. The tank of claim 1, wherein the heating element comprises a coil extending along a longitudinal axis of the tank.

8. The tank of claim 1, wherein:

the heating element comprises a vertical coil coaxial with an airway of the tank; and wherein the insulating element is coupled to an inner surface of the outer housing to at least partially insulate the outer housing from heat generated by the heating element.

9. The tank of claim 1, further comprising a connector coupled to the atomizer, wherein the connector is configured to electrically connect the atomizer to a power supply.

10. The tank of claim 9, wherein the connector comprises a housing that includes at least one notch to provide an air inlet in communication with an airway of the tank.

11. The tank of claim 10, wherein the at least one notch comprises a plurality of notches, and wherein the connector includes a skirt portion that includes the plurality of notches and extends from an end of the atomizer.

12. The tank of claim 10, further comprising a sleeve coupled to an outer surface of the connector housing, the sleeve including at least one aperture that corresponds to the at least one notch of the connector, wherein the sleeve is moveable with respect to the connector for adjusting a size of the air inlet.

13. The tank of claim 1, further comprising a mouthpiece integral with the reservoir, wherein the reservoir is between the mouthpiece and the atomizer.

14. The tank of claim 1, wherein the reservoir surrounds an airway configured to receive vaporized liquid.

15. The tank of claim 1, wherein the reservoir is transparent.

16. A tank for a vaporizing device, the tank comprising:

a housing that contains a wick, an insulating element, and a heating element, with the wick, the insulating element, and the heating element enclosed within the housing;

a reservoir adjacent to the housing, the reservoir being configured to contain a liquid; and a barrier that separates the wick from the reservoir, wherein the barrier includes a central opening, the barrier being at least partially permeable to allow for transfer of liquid from the reservoir to the wick through a portion of the barrier radially outward of the central opening;

wherein the heating element is separated from the housing by an air gap, and wherein the wick is radially inward of a walled structure, the insulating element is radially between the walled structure and the housing, and the air gap is radially outward of the wick and radially between the walled structure and the insulating element.

17. The tank of claim 16, wherein the insulating element is coupled to an inner surface of the housing to at least partially insulate the housing from heat generated by the heating element;

wherein the heating element extends at least partially along a longitudinal axis of the tank, and wherein the wick at least partially radially surrounds the heating element.

18. The tank of claim 16, further comprising the liquid, wherein the reservoir defines a container coupled to the barrier, such that the liquid exits the reservoir only through the barrier.

19. A tank for a vaporizing device, the tank comprising:

an atomizer including a housing that encloses a wick, a heating element, a barrier, and an insulating element, wherein the wick comprises an absorbent material; and a reservoir adjacent to the atomizer, the reservoir being configured to contain a liquid;

wherein the barrier of the atomizer separates the wick from the reservoir, the barrier being porous to allow for transfer of liquid from the reservoir to the wick;

wherein the insulating element is coupled to the housing to at least partially insulate the housing from heat generated by the heating element; and wherein the wick is radially inward of a walled structure, the insulating element is radially between the walled structure and the housing, and an air gap is radially between the walled structure and the insulating element.

20. The tank of claim 19, further comprising a connector coupled to the atomizer, wherein the connector is configured to electrically connect the atomizer to a power supply;

wherein the heating element extends at least partially along a longitudinal axis of the tank, and wherein the wick at least partially radially surrounds the heating element.

* * * * *